US010343257B2

(12) United States Patent
Jang

(10) Patent No.: US 10,343,257 B2
(45) Date of Patent: Jul. 9, 2019

(54) WAFER GRINDING DEVICE

(71) Applicant: LG SILTRON INC., Gyeongsangbuk-do (KR)

(72) Inventor: Jun-Young Jang, Gyeongsangbuk-do (KR)

(73) Assignee: SK Siltron Co., Ltd. (KR)

( * ) Notice: Subject to any disclaimer, the term of this patent is extended or adjusted under 35 U.S.C. 154(b) by 18 days.

(21) Appl. No.: 15/110,405

(22) PCT Filed: Jun. 9, 2014

(86) PCT No.: PCT/KR2014/005048
§ 371 (c)(1),
(2) Date: Jul. 7, 2016

(87) PCT Pub. No.: WO2015/108252
PCT Pub. Date: Jul. 23, 2015

(65) Prior Publication Data

US 2016/0318152 A1 Nov. 3, 2016

(30) Foreign Application Priority Data

Jan. 15, 2014 (KR) ..... 10-2014-0004854

(51) Int. Cl.
*B24B 55/02* (2006.01)
*B24B 7/22* (2006.01)
(Continued)

(52) U.S. Cl.
CPC ..... *B24B 55/02* (2013.01); *B24B 7/228* (2013.01); *B24D 7/10* (2013.01); *B24D 13/18* (2013.01)

(58) Field of Classification Search
CPC ..... B24B 55/02; B24B 55/03; B24B 55/045; B24B 7/228; B24D 7/10; B24D 13/18
See application file for complete search history.

(56) References Cited

U.S. PATENT DOCUMENTS 3,978,625 A * 9/1976 Klaassen ..... B24B 55/02 451/450
6,095,899 A * 8/2000 Elmar ..... B24B 7/228 451/28
(Continued)

FOREIGN PATENT DOCUMENTS

GB 2012195 A * 7/1979 ..... B24B 55/02
JP 54-101592 A 8/1979
(Continued)

OTHER PUBLICATIONS

JP Office action dated Apr. 25, 2017 issued in corresponding JP Application No. 2016-563763, 6 pages.
(Continued)

*Primary Examiner* — Joseph J Hail
*Assistant Examiner* — J Stephen Taylor
(74) *Attorney, Agent, or Firm* — Lewis Roca Rothgerber Christie LLP

(57) ABSTRACT

The present disclosure provides a wafer grinding device comprising: a chuck table to suction the wafer thereon, a grinding wheel to grind the wafer by a predetermined thickness, wherein the grinding wheel includes a grinding body, and grinding teeth arranged along and on a bottom outer periphery of the grinding body, wherein the grinding teeth are segmented; and a cooling unit at least partially extending along a region between a departure point of the grinding teeth from the wafer during rotation of the teeth, and a re-encounter point of the teeth with the wafer during rotation of the teeth, wherein the region extends along rotation path of the grinding teeth.

5 Claims, 7 Drawing Sheets

(51) Int. Cl.
*B24D 7/10* (2006.01)
*B24D 13/18* (2006.01)

(56) References Cited

U.S. PATENT DOCUMENTS

| | | | | |
|---|---|---|---|---|
| 6,168,499 | B1 | 1/2001 | Jang | |
| 6,193,586 | B1 * | 2/2001 | Park | B24B 7/228 451/388 |
| 7,353,560 | B2 * | 4/2008 | Boyd | H01L 21/67046 134/902 |
| 8,449,356 | B1 * | 5/2013 | Sae-Lee | B24B 55/02 29/890.09 |
| 2003/0077993 | A1 | 4/2003 | Shimobeppu et al. | |
| 2004/0072513 | A1 * | 4/2004 | Webster | B05B 1/00 451/56 |
| 2008/0051013 | A1 * | 2/2008 | Burgess | B23F 15/06 451/51 |
| 2012/0118278 | A1 * | 5/2012 | La Banco | B23D 47/025 125/35 |
| 2013/0217305 | A1 | 8/2013 | Koutake et al. | |
| 2016/0176020 | A1 * | 6/2016 | Nishimura | B24D 7/18 451/178 |

FOREIGN PATENT DOCUMENTS

| | | | | |
|---|---|---|---|---|
| JP | 63-288655 | A | | 11/1988 |
| JP | 02-150148 | U | | 12/1990 |
| JP | 11-300614 | A | | 11/1999 |
| JP | 2000-216122 | A | | 8/2000 |
| JP | 2000-288883 | A | | 10/2000 |
| JP | 2000288883 | A | * | 10/2000 |
| JP | 2001-096461 | A | | 4/2001 |
| JP | 2003-197581 | A | | 7/2003 |
| JP | 2007-237363 | | | 9/2007 |
| JP | 2013-169610 | A | | 9/2013 |
| JP | 2013-212555 | A | | 10/2013 |
| JP | 2013212555 | A | * | 10/2013 |
| KR | 10-1999-0086236 | A | | 12/1999 |

OTHER PUBLICATIONS

International Search Report for corresponding PCT Application PCT/KR2014/005048 dated Oct. 27, 2014 (4 pages).
Extended European Search Report, issued in corresponding Application No. 14878856.5-1702/3096348 dated Sep. 15, 2017, 3 pages.
CN Office Action dated Feb. 28, 2018 issued in corresponding CN Application No. 201480073418.3 (5 pages).

* cited by examiner a-a

WAFER GRINDING DEVICE

CROSS-REFERENCE TO RELATED APPLICATION

This application is a national phase application of International Application PCT/KR2014/005048, with an international filing date of Jun. 9, 2014, which claims the benefit of Korea Patent Application No. 10-2014-0004854 filed on Jan. 15, 2014, the entire content of which is incorporated herein by reference for all purposes as if fully set forth herein.

BACKGROUND

Field of the Present Disclosure

The present disclosure relates to a wafer grinding device, and, more particularly, to a wafer grinding device to suppress wafer deformation due to rotation of a grinding wheel contacting a wafer surface when grinding the wafer surface.

Discussion of the Related Art

Generally, a silicon single crystal wafer used to produce electronics such as semiconductor device, etc. Furthermore, such a silicon single crystal wafer according to the present invention can be manufactured by the following manufacturing method. However, the present invention is not restricted thereto.

First, a silicon single crystal ingot is prepared. A general ingot can be prepared as this silicon single crystal ingot, and this ingot can be grown based on, e.g., the Czochralski method.

Then, the prepared silicon single crystal ingot is sliced to provide a plurality of sliced substrates. This slicing can be performed by a general method, and slicing can be performed by using a cutting device such as an inner diameter slicer or a wire saw.

Furthermore, at least one of lapping, etching, and polishing is performed with respect to the plurality of obtained sliced substrates to provide substrates. The lapping, the etching, and the polishing can be performed under general conditions, and they can be appropriately selected in accordance with a specification of a silicon single crystal wafer to be manufactured.

Before the lapping and polishing and after the slicing, the silicon single crystal wafer may be further grinded to control the thickness and flatness. This process may be referred to as a grinding process.

The grinding process may satisfy the very high precision of flatness required for the semiconductor device with a high integration degree. In this connection, the wafer flatness may be defined by a SBIR (site backside ideal range) including a TTV (total thickness variation) indicating a difference between maximum and minimum wafer thicknesses, and a LTV (local thickness variation). As a design rule of the semiconductor device gets finer, it may be difficult to obtain a high quality wafer to meet the TTV and SBIR related requirements only using the lapping and polishing process. Thus, in order to meet the wafer flatness requirements, the grinding process may be further needed.

FIG. 1 illustrates a silicon wafer grinding device for grinding the wafer. As shown in FIG. 1, the conventional wafer grinding device includes a spindle 10, a grinding wheel 11 coupled to a bottom of the spindle 10 and configured to rotate, and a chuck table 15 configured to suction the wafer.

When the wafer W is loaded on the chuck table 15, the chuck table 15 suctions the wafer W using a vacuum pressure and enable the suctioned wafer W to rotate in a given rate. When the spindle 10 spaced from and above the chuck table 15 at a predetermined distance rotates and descends, the spindle 10 may contact the wafer and grind the wafer using the grinding wheel 11 coupled thereto.

The grinding wheel 11 include a rotatable grinding body 12, and grinding teeth 13 coupled to a bottom edge of the grinding body 12. The previous grinding wheel 11 may be configured such that the grinding teeth 13 made of a diamond are spaced from each other at a predetermined distance and are bonded to the body 12 via an adhesive, and protrude downwards from the body 12. In this way, when the chuck table 15 suctions the silicon wafer, and the spindle 10 rotates in a high speed, the previous grinding wheel 11 rotates to grind the wafer surface using the grinding teeth 13 thereof.

However, when grinding the wafer using the grinding wheel 11, a hot heat may be created in the grinding wheel 11 and wafer W due to the high speed rotation. This heat may be accumulated in the grinding wheel 11, thereby to increase a working load during the grinding process, and to cause the wafer burning, etc.

Further, a grinding byproduct may be attached onto fine holes in a working face of each of the grinding teeth 13, to deteriorate a grinding force of the grinding teeth 13. This may be referred to as a hole-blocked event. This event may increase an working time to achieve a wafer target thickness. This may lead to a lowered yield of the wafer. Further, this may lead to poor wafer flatness and nano-quality.

SUMMARY

Embodiments of the present disclosure provide a wafer grinding device to allow the grinding wheel to be effectively cooled during grinding the wafer surface, to prevent a shock or heat from be applied to the wafer.

Embodiments of the present disclosure provide a wafer grinding device to allow the grinding byproduct to be effectively discharged outside of the grinding wheel during grinding the wafer surface, to keep a grinding force of the grinding wheel constant.

In one aspect of the present disclosure, there is provided a wafer grinding device comprising: a chuck table configured to load a wafer thereon, to suction the wafer thereon, and to enable the suctioned wafer to be rotated in a predetermined speed; a spindle spaced from and above the chuck table at a predetermined distance, wherein the spindle is configured to descend and grind the suctioned wafer on the chuck table, wherein the spindle comprises: a driver unit configured to enable a grinding wheel to be rotated at a predetermined speed and be descend by a predetermined distance to contact the wafer; and the grinding wheel disposed coupled to the driver unit to grind the wafer by a predetermined thickness, wherein the grinding wheel includes a grinding body, and grinding teeth arranged along and on a bottom outer periphery of the grinding body, wherein the grinding teeth are segmented; and a cooling unit at least partially extending along a region between a departure point of the grinding teeth from the wafer during rotation of the teeth, and a re-encounter point of the teeth with the wafer during rotation of the teeth, wherein the region extends along rotation path of the grinding teeth.

In one embodiment, the cooling unit is configured to dispense a cooling liquid or gas to the grinding teeth passing therethrough.

In one embodiment, the cooling unit extends along a circular arc having a center of the grinding wheel as a center thereof and a length corresponding to 120 degree.

In one embodiment, the cooling unit includes a body formed in a circular arc shape having a center of the grinding wheel as a center thereof and having a curvature substantially equal to a curvature of the grinding wheel; and a groove formed in the body to allow the grinding teeth to pass therethrough.

In one embodiment, the descended grinding teeth are partially inserted into the groove, wherein the body is spaced from outer side and bottom faces of the grinding teeth inserted in the groove at a predetermined distance.

In one embodiment, an inner bottom face of the body has a plurality of first dispensing holes formed therein, wherein the first dispensing holes are configured to dispense the cooling liquid or gas to outer bottom faces of the grinding teeth, wherein an inner side face of the body has a plurality of second dispensing holes formed therein, wherein the second dispensing holes are configured to dispense the cooling liquid or gas to outer side faces of the grinding teeth.

In one embodiment, the first and second dispensing holes have predetermined sizes along an extension of the groove, wherein the first dispensing holes are spaced from each other at a first predetermined distance, and the second dispensing holes are spaced from each other at a second predetermined distance.

In one embodiment, the sizes of the first dispensing holes are gradually smaller along the rotation direction of the grinding teeth, and the spacing distances between the first neighboring dispensing holes are gradually larger along the rotation direction of the grinding teeth; and/or the sizes of the second dispensing holes are gradually smaller along the rotation direction of the grinding teeth, and the spacing distances between the second neighboring dispensing holes are gradually larger along the rotation direction of the grinding teeth.

In one embodiment, the second dispensing holes have different vertical positions in the inner side face of the body.

In one embodiment, the first and second dispensing holes are fluid-communicated with each other in the cooling unit, wherein the device further includes a supply tube coupled to one of the dispensing holes.

In one embodiment, the device further includes a supply tank coupled to the supply tube, wherein in the supply tank, the cooling liquid or gas is kept at a predetermined temperature.

In one embodiment, the device further includes a drying unit disposed between a departure point of the grinding teeth from the cooling unit and the re-encounter point of the grinding teeth with the wafer, wherein the drying unit is configured to dry the dispensed cooling liquid to the grinding teeth.

In one embodiment, the drying unit is formed in a circular arc shape having a curvature substantially equal to a curvature of the grinding wheel, and having a center of the grinding wheel as a center thereof, and having a length corresponding to a predetermined angle.

In one embodiment, the drying unit is spaced from the grinding wheel at a predetermined distance, wherein the drying unit has a plurality of through-holes formed therein, wherein each through-hole is directed toward the center of the grinding wheel, wherein each through-hole is configured to dispense a drying air to the grinding teeth passing beyond the cooling unit.

In one embodiment, the device further includes a grinding water supply tube in the spindle, wherein the grinding water supply tube is configured to allow the grinding water to be supplied to a contact location between the grinding wheel and wafer, wherein the cooling liquid temperature is substantially equal to the grinding water temperature.

The present disclosure has following effects:

The grinding wheel passes through the cooling unit just after performing the grinding process. Thus, the grinding wheel temperature may be kept at a constant level. This may suppress the wafer deformation.

The grinding byproduct remaining on the grinding wheel may be removed via a rotation force after passing through the cooling unit. This may kept the grinding force of the grinding wheel at a constant level. This may improve a wafer grinding quality.

BRIEF DESCRIPTIONS OF THE DRAWINGS

The accompanying drawings, which are included to provide a further understanding of the present disclosure and are incorporated in and constitute a part of this specification, illustrate embodiments of the present disclosure and together with the description serving to explain the principles of the present disclosure. In the drawings.

Figure 5B:
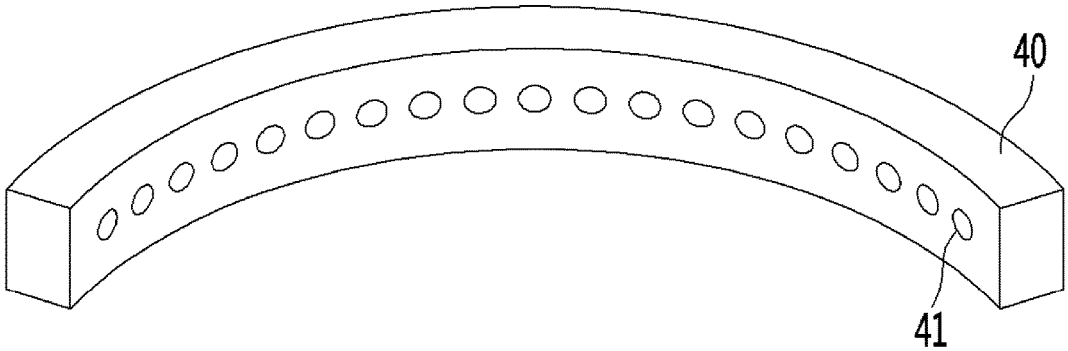
Figure 5A:
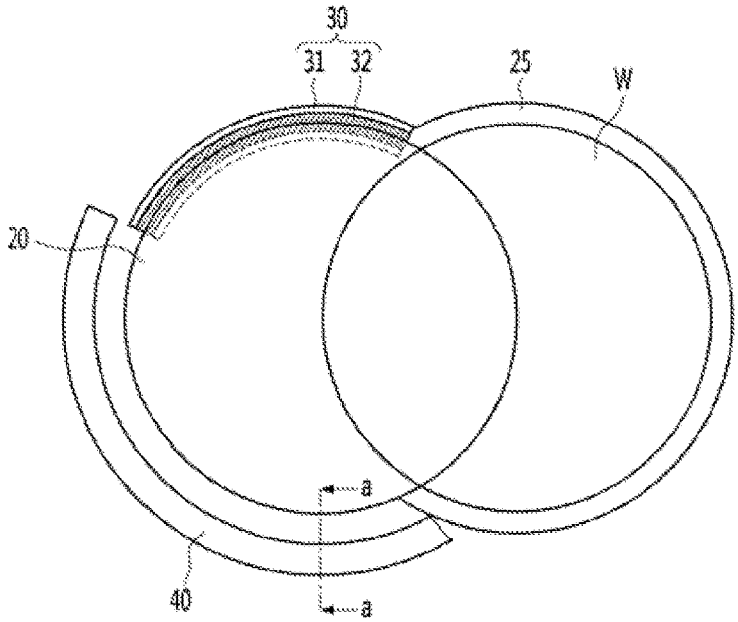
Figure 5C:
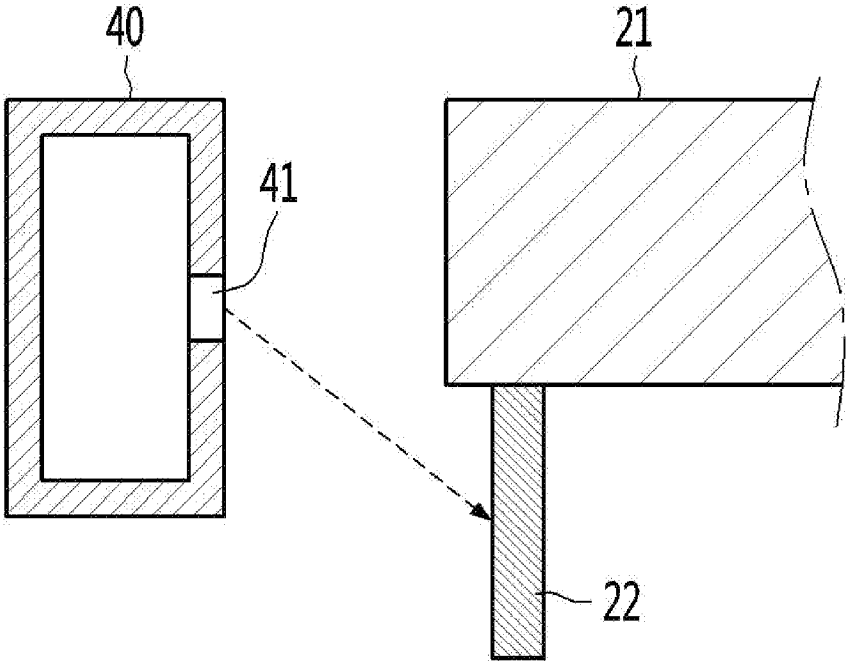

FIG. 5A shows a top view of a wafer grinding device in accordance with one embodiment of the present disclosure. FIG. 5B shows a perspective view of the dry unit in accordance with one embodiment of the present disclosure. FIG. 5C shows a cross-sectional view taken along the line a-a in FIG. 5A.

Figure 6:
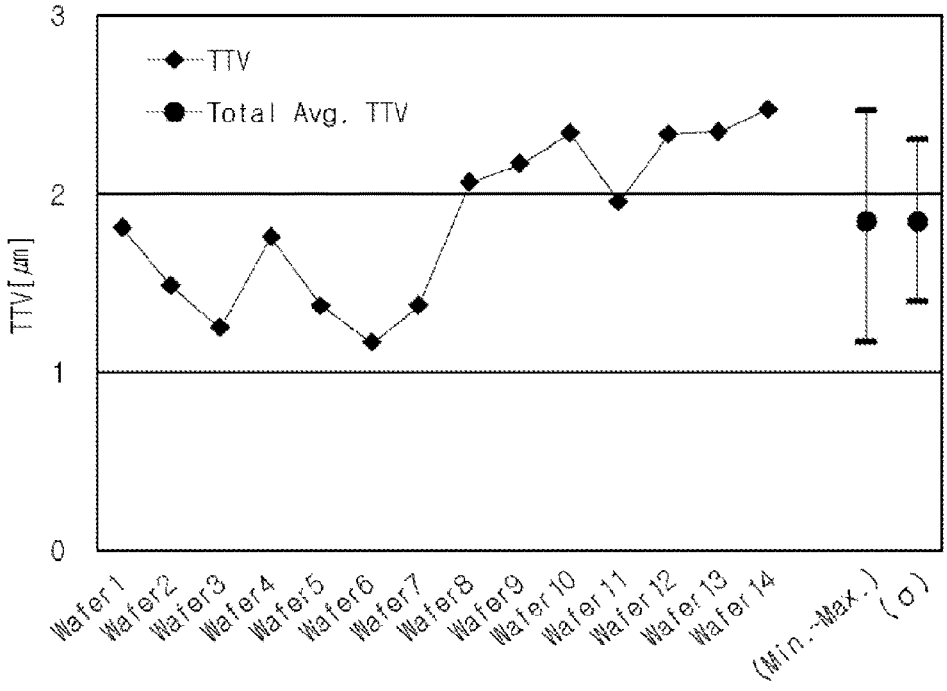

FIG. 6 shows a graph of TTVs of wafers resulting from the previous wafer grinding device.

Figure 7:
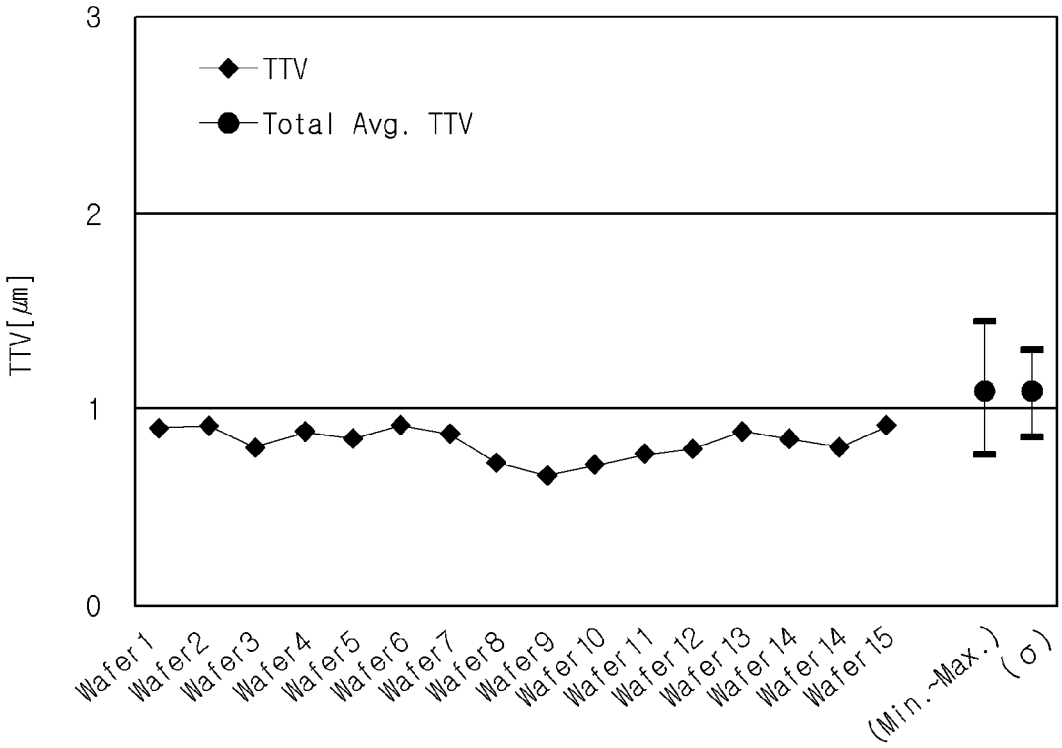

FIG. 7 shows a graph of TTVs of wafers resulting from the present wafer grinding device.

DETAILED DESCRIPTIONS

Examples of various embodiments are illustrated in the accompanying drawings and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

Hereinafter, various embodiments of the present disclosure will be described in details with reference to attached drawings.

Figure 1:
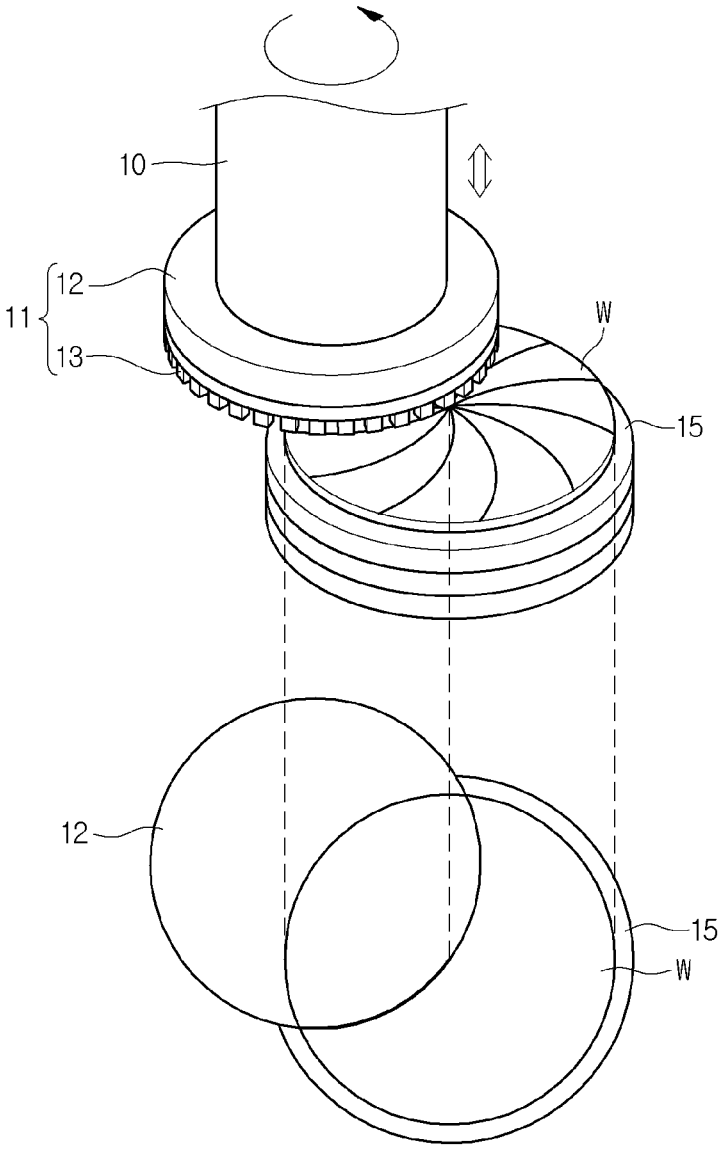
FIG. 1 shows a perspective view of the previous wafer grinding device.
Figure 2:
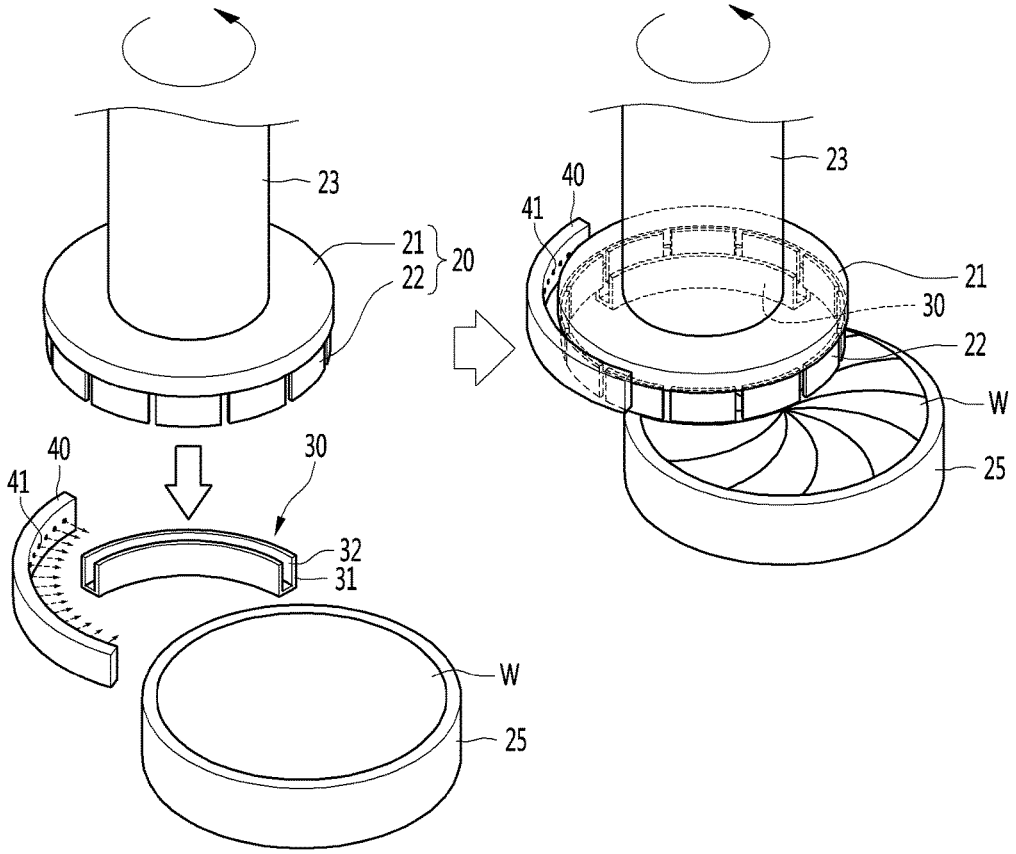
FIG. 2 shows a perspective view of a wafer grinding device in accordance with one embodiment of the present disclosure.

FIG. 2 shows a perspective view of a wafer grinding device in accordance with one embodiment of the present disclosure. Referring to FIG. 2, the wafer grinding device in accordance with one embodiment of the present disclosure may include a chuck table 25 configured to suction a wafer when loaded thereon, and to enable the suctioned wafer to rotate at a predetermined speed, and a spindle 23 spaced from and above the chuck table 25 at a predetermined distance, wherein the spindle 23 may be configured to rotate and descend to grind the suctioned wafer W on the chuck table 25.

The spindle 23 may include a driver unit configured to rotate at predetermined speed and to enable a grinding wheel 20 to be descended by a predetermined distance to contact the wafer, and the grinding wheel 20 disposed on a bottom of the driver unit to be configured to grind the wafer by a predetermined thickness thereof.

The chuck table 25 may be formed of a circular plate with a slightly larger area than that of the wafer to allow the wafer to be rested thereon safely. The chuck table 25 may have separated vacuum spaces formed therein to suction the wafer.

The grinding wheel 20 may include a grinding body 21 and grinding teeth 22. The grinding teeth 22 may be arranged along and on a bottom edge of the grinding body 21 and may be segmented from each other. The present grinding device may further include a cooling unit 30 disposed at least partially in a predetermined region between first and second points, wherein from the first point, the grinding teeth 22 depart from the wafer during rotation thereof, and from the second point, the grinding teeth 22 re-encounter the wafer during rotation thereof. The cooling unit 30 may be configured to cool the grinding teeth 22 passing therethrough using a cooling liquid or gas.

Figure 3:
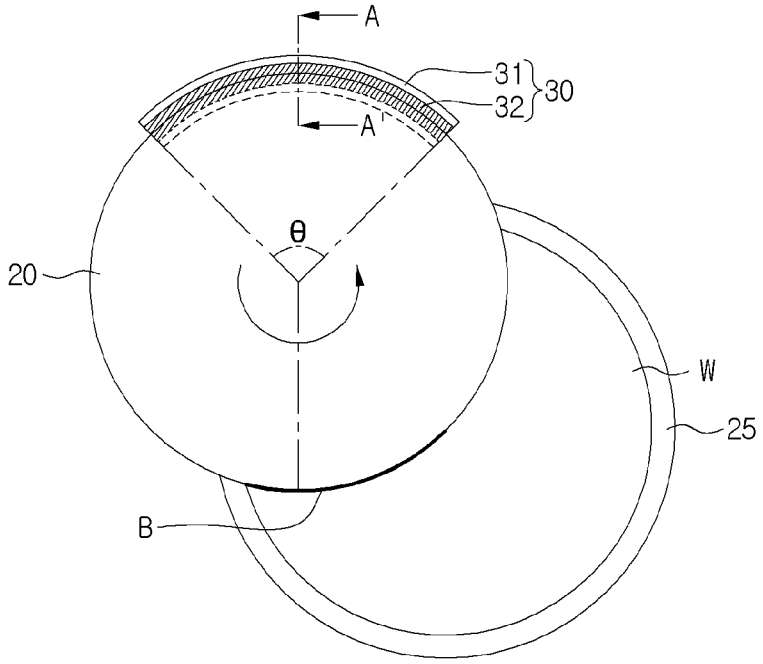
FIG. 3 shows a top view of a wafer grinding device in FIG. 2.

As shown in FIG. 2 to FIG. 4, the cooling unit 30 may at least partially extend along a rotation path of the grinding wheel 20. To be specific, the cooling unit 30 may at least partially extend along a rotation path of the grinding teeth 22. The cooling unit 30 may at least partially extend along a predetermined region between the first and second points, wherein from the first point, the grinding teeth 22 depart from the wafer during rotation thereof, and from the second point, the grinding teeth 22 re-encounter the wafer during rotation thereof. In this connection, the cooling unit 30 may have a circular arc shape having a center of the grinding wheel 20 as a center thereof, and a length corresponding to a predetermined angle.

The cooling unit 30 may include a body 31 at least partially extending along the rotation path of the grinding teeth 22, and having a circular arc shape with a curvature substantially equal to that of the rotation path of the grinding teeth 22. The cooling unit 30 may include a groove 32 defined in the body 31 to allow the grinding teeth 22 to pass therethrough. The groove 32 may have a predetermined depth. Thus, when the grinding wheel 20 descends by the driver unit of the spindle 23, some of the grinding teeth 22 may contact the wafer, and the other of the grinding teeth 22 may be at least partially inserted into the groove 32. The body 31 may not contact the grinding teeth 22. That is, the body 31 may be spaced from the grinding teeth 22 at a predetermined distance to at least partially receive the grinding teeth 22.

In this regard, when the grinding wheel 20 rotates, the grinding teeth 22 may grind the wafer. At this time, the grinding teeth 22 departing from the wafer may pass through the groove 32 in the body 31 of the cooling unit 30.

FIG. 3 shows a top view of the wafer grinding device in FIG. 2. Referring to FIG. 3, when the wafer W may be rested on and be suctioned by the chuck table 25, the grinding wheel 20 may descends via the driver unit, to contact the wafer region including a center of the wafer. The suctioned wafer may be tilted downwards by a few μm due to a vacuum pressure. The grinding wheel 20 may actually grind a wafer region B. The grinding may be carried out along the arc shape in accordance with rotation of chuck table 25.

The cooling unit 30 of the present wafer grinding device may at least partially extend along a predetermined region between the first and second points, wherein from the first point, the grinding teeth 22 depart from the wafer during rotation thereof, and from the second point, the grinding teeth 22 re-encounter the wafer during rotation thereof. In this connection, the cooling unit 30 may have a circular arc shape having a center of the grinding wheel 20 as a center thereof, and a length corresponding to a predetermined angle θ. Preferably, the predetermined angle θ may be 120 degree.

As will be described later, since the cooling unit 30 sprays a cooling liquid to cool the grinding wheel 20, the cooling liquid polluted with the grinding byproduct may remain on the grinding wheel 20 which has passed through the cooling unit 30. Thus, in order that the polluted cooling liquid may not contact the wafer surface to be grinded, the polluted cooling liquid should be removed by the rotation force of the grinding wheel 20. For this, a space available for removing the polluted cooling liquid is required. Thus, this space may be defined between one end of the cooling unit 30 and the departing or re-encountering points between the grinding teeth and wafer. In this connection, for securing the space, it may be preferable that the predetermined angle θ is 120 degree.

Figure 4A:
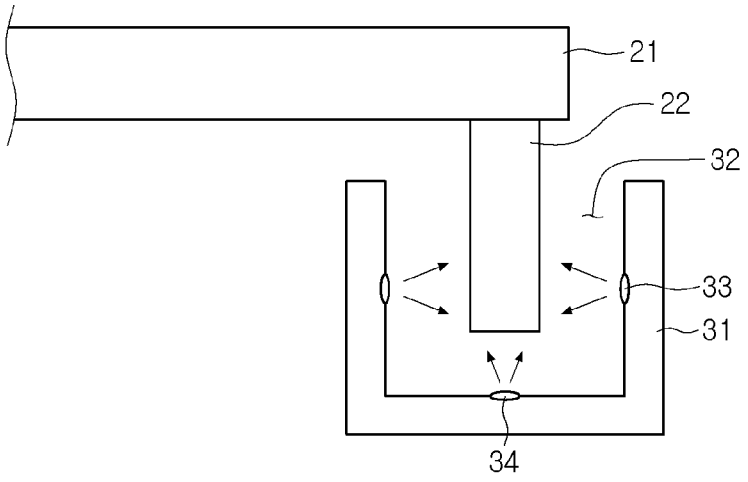
FIG. 4A shows a cross-sectional view of the wafer grinding device in FIG. 3 taken at a line A-A'.
Figure 4B:
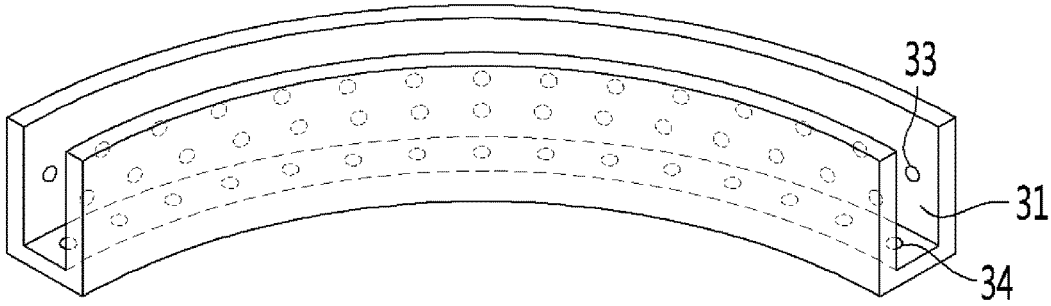
FIG. 4B shows a perspective view of the cooling unit in accordance with one embodiment of the present disclosure.

FIG. 4A shows a cross-sectional view of the wafer grinding device in FIG. 3 taken at a line A-A' and FIG. 4B shows a perspective view of the cooling unit in accordance with one embodiment of the present disclosure. Referring to FIG. 4A and FIG. 4B, the present wafer grinding device may include the cooling unit 30 to lower the temperature of the rotating grinding wheel 20, wherein the cooling unit 30 may have a following configuration.

The cooling unit 30 may include the body 31 at least partially extending along the rotation path of the grinding teeth 22, and having a circular arc shape with a curvature substantially equal to that of the rotation path of the grinding teeth 22. The cooling unit 30 may include the groove 32 defined in the body 31 to allow the grinding teeth 22 to pass therethrough. The groove 32 may have a predetermined depth.

Further, a plurality of dispensing holes 33 and 34 may be formed in the inner side face and inner bottom face of the body 31 to lower the temperature of the grinding teeth 22 using the cooling liquid dispensed from the holes. The dispensing holes may be classified into the inner side face dispensing holes 33 configured to dispense the cooling liquid to the outer side face of the grinding teeth 22, and the inner bottom face dispensing holes 34 configured to dispense the cooling liquid to the outer bottom face of the grinding teeth 22. The dispensing holes 33 and 34 may have predetermined sizes. The dispensing holes 33 and 34 may be configured to dispense the cooling liquid or gas to the outer side face and bottom face respectively of the grinding teeth 22 passing through the groove 32 of the cooling unit 30 at a predetermined pressure. Spacing distance, number, size, etc. of the dispensing holes 33 and 34 may vary based on a diameter of the wafer or types of the grinding process.

The inner side face dispensing holes 33 and inner bottom face dispensing holes 34 may have predetermined sizes in an extending direction of the groove. The dispensing holes may be spaced from each other at a predetermined distance. In one example, the inner side face dispensing holes and inner bottom face dispensing holes may have sizes being gradually smaller along the rotation path of the grinding teeth, while the spacing distances between the neighboring dispensing holes may be gradually larger along the rotation path of the grinding teeth. In this way, at the departure point of the grinding teeth from the wafer, the cooling liquid or gas may be dispensed by a relatively larger amount to increase a cooling level. Thus, the overall temperature of the grinding teeth may be controlled uniformly.

The plural inner side face dispensing holes 33 may be formed in the inner side face of the body 21 of the cooling unit 30 and along the rotation path of the grinding teeth.

In one example, the inner side face dispensing holes 33 formed along the rotation path of the grinding teeth may be located at different levels or heights. Thus, the entire outer side face of the grinding teeth 22 passing through the groove 32 may be cooled by the cooling liquid or gas.

By dispensing the cooling liquid or gas, the grinding byproduct generated from a contact between the wafer and the grinding teeth 22 and remaining on the grinding teeth 22 may be removed away when the grinding teeth 22 pass through the cooling unit 30. Further, the heat generated from a contact between the wafer and the grinding teeth 22 and accumulated in the grinding wheel may be removed from the grinding wheel, to suppress the wafer deformation.

The dispensing holes 33 and 34 may be fluid-communicated with each other in the cooling unit 30. Below the cooling unit 30, a supply tube and a supply tank may be disposed to supply the cooling liquid or gas to the dispensing holes 33 and 34. The supply tube may be coupled to one end of the cooling unit 30. The supply tube may be controlled to supply a predetermined amount of the cooling liquid or gas to the holes when the grinding teeth 22 contacts the wafer and rotates. In this connection, the supply tube may be controlled such that the dispensing holes may dispense the cooling liquid or gas at a predetermined pressure, and, thus the grinding wheel 20 including the grinding teeth 22 may be cooled.

Moreover, in order that the body 31 of the cooling unit 30 should not contact the grinding teeth 22 during the rotation of the grinding teeth 22, that is, the body 31 should be spaced from the grinding teeth 22, the body 31 of the cooling unit 30 may be fixed to a fixture extending downwards.

Again referring to FIG. 2, a circulated water is supplied into the spindle 23 rotating at a predetermined speed to lower the temperature of the spindle itself. For this, the circulated water flows in the spindle 23. Further, a grinding water passes through the spindle to be supplied to the grinding wheel 20. The grinding water may be dispensed to a contact position between the grinding wheel 20 and wafer to cool the grinding location. For this, a grinding water supply tube may be installed.

Generally, the grinding water may be embodied as a ultra-pure water which is kept at 20 to 25 ° C. temperature. The grinding water may act to keep the temperature of the grinding wheel and inner components thereof at a constant level, and to lower the grinding location temperature to an initial temperature of the grinding wheel 20.

When a difference between the temperature of the grinding water to be dispensed to the grinding location and the temperature of the cooling liquid to be dispensed to the grinding wheel 20 via the cooling unit 30 exceeds a predetermined value, the wafer deformation may occur during the wafer grinding process. Thus, it may be preferable that the temperature of the cooling liquid to be dispensed via the dispensing holes 33 and 34 of the cooling unit 30 is set to be substantially equal to the temperature of the grinding water.

FIG. 5B shows a top view of a wafer grinding device in accordance with one embodiment of the present disclosure, FIG. 5B shows a perspective view of a dry unit in accordance with one embodiment of the present disclosure, and FIG. 5C shows a cross-sectional view taken along the line a-a in FIG. 5A. Referring to FIG. 5A, FIG. 5B, and FIG. 5C, the present wafer grinding device may include a drying unit 40 nearby the cooling unit 30. The drying unit 40 may be configured to dry the dispensed cooling liquid to the grinding wheel 20. The drying unit 40 may be disposed between a departure point of the grinding teeth from the cooling unit 30 and a grinding location of the wafer.

To be specific, the cooling unit 30 may extend along a circular arc having a center of the grinding wheel 20 as a center thereof and a length corresponding to 120 degree. The drying unit 40 may be disposed between a departure point of the grinding teeth 22 from the cooling unit 30 and a re-encounter point of the grinding teeth 22 with the wafer.

The drying unit may be formed in a circular arc shape with a curvature substantially equal to a curvature of the grinding wheel. The drying unit may be spaced from the grinding wheel at a predetermined distance. The drying unit may be formed in a circular arc shape having a curvature substantially equal to a curvature of the grinding wheel, and having a center of the grinding wheel as a center thereof, and having a length corresponding to a predetermined angle. In one example, the predetermined angle may be 120 degree.

The drying unit 40 may have a predetermined number of through-holes formed therein. Each through-hole is directed toward the center of the grinding wheel, wherein each through-hole is configured to dispense a drying air to the grinding teeth passing beyond the cooling unit. In this way, the cooling liquid wet on the grinding teeth 22 may be rapidly removed. This may allow the grinding byproduct remaining on the grinding teeth 22 to be easily removed from the grinding teeth 22. Because of the removed grinding byproduct, it may be preferable that the drying unit 40 is disposed at a slightly higher position than the grinding teeth 22, and, thus, dispenses the drying air downwards to the grinding teeth 22.

In this way, during the grinding teeth 22 is passing through the cooling unit 30, the grinding teeth is cooled and the grinding byproduct thereon is removed via the dispense of the cooling liquid. Then, after the grinding teeth 22 passes through the cooling unit 30, that is, during the grinding teeth is passing through the drying unit 40, the cooling liquid on the grinding teeth 22 is removed via the dispense of the drying air.

FIG. 6 shows a graph of TTVs of wafers resulting from the previous wafer grinding device. FIG. 7 shows a graph of TTVs of wafers resulting from the present wafer grinding device.

The TTV (total thickness variation) of the wafer refers to a difference between maximum and minimum wafer thicknesses resulting from the wafer grinding process. The smaller the TTV value is, the higher the wafer quality from the wafer grinding process by the wafer grinding device is.

As shown in FIG. 6 which is directed to the conventional wafer grinding device, for a plurality of wafers, TTV values all are above 1 μm. Deviations for the TTV values are above 1 μm. However, as shown in FIG. 7 which is directed to the present wafer grinding device, for a plurality of wafers, TTV values is below 1 μm. Deviations for the TTV values are below 0.5 μm.

Thus, the present wafer grinding device may improve the wafer flatness.

To be specific, in the present disclosure, the grinding wheel passes through the cooling unit just after performing the grinding process. Thus, the grinding wheel temperature may be kept at a constant level. This may suppress the wafer deformation.

The grinding byproduct remaining on the grinding wheel may be removed via a rotation force after passing through the cooling unit. This may kept the grinding force of the grinding wheel at a constant level. This may improve a wafer grinding quality.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims.

What is claimed is:

1. A wafer grinding device comprising:

a chuck table configured to load a wafer thereon, to suction the wafer thereon, and to enable the suctioned wafer to be rotated in a predetermined speed;

a spindle spaced from and above the chuck table at a predetermined distance, wherein the spindle is configured to descend and grind the suctioned wafer on the chuck table, wherein the spindle comprises a grinding wheel disposed coupled to the driver unit to grind the wafer by a predetermined thickness, wherein the grinding wheel includes a grinding body, and grinding teeth arranged along and on a bottom outer periphery of the grinding body, wherein the grinding teeth are segmented a cooling unit configured to dispense a cooling liquid or gas to the grinding teeth passing therethrough; and a drying unit configured to dispense a drying air to the grinding teeth passing beyond the cooling unit;

wherein the cooling unit comprises:

a body formed in a circular arc shape having a center of the grinding wheel as a center thereof and having a curvature substantially equal to a curvature of the grinding wheel; and a groove formed in the body to allow the grinding teeth to pass therethrough, wherein an inner bottom face of the body has a plurality of first dispensing holes formed therein, wherein the first dispensing holes are configured to dispense the cooling liquid or gas to outer bottom faces of the grinding teeth, and wherein an inner side face of the body has a plurality of second dispensing holes formed therein, wherein the second dispensing holes are configured to dispense the cooling liquid or gas to outer side faces of the grinding teeth, wherein the cooling unit and the drying unit are located continuously along a region between a departure point of the grinding teeth from the wafer and a re-encounter point of the grinding teeth with the wafer during rotation of the grinding wheel, wherein the drying unit is disposed at a higher position than the grinding teeth and positioned on an outer circumferential side of the grinding teeth and formed in a circular arc shape having a center of the grinding wheel as a center thereof and having a radius of curvature larger than a radius of curvature of the cooling unit, having a plurality of through-holes formed on the drying unit's inner circumference to dispense a drying air to the grinding teeth.

2. The device of claim 1, wherein the descended grinding teeth are partially inserted into the groove, wherein the body is spaced from outer side and bottom faces of the grinding teeth inserted in the groove at a predetermined distance.

3. The device of claim 1, wherein the first and second dispensing holes have predetermined sizes along an extension of the groove, wherein the first dispensing holes are spaced from each other at a first predetermined distance, and the second dispensing holes are spaced from each other at a second predetermined distance.

4. The device of claim 1, wherein the drying unit is spaced from the grinding wheel at a predetermined distance, wherein each through-hole of the drying unit is directed toward the center of the grinding wheel, wherein each through-hole is configured to dispense a drying air to the grinding teeth passing beyond the cooling unit.

5. The device of claim 1, wherein the device further includes a grinding water supply tube in the spindle, wherein the grinding water supply tube is configured to allow the grinding water to be supplied to a contact location between the grinding wheel and wafer, wherein the cooling liquid temperature is substantially equal to the grinding water temperature.

* * * * *